US008311435B2

(12) United States Patent
Kushida

(10) Patent No.: US 8,311,435 B2
(45) Date of Patent: Nov. 13, 2012

(54) DISPLACEMENT DETECTION AND CORRECTION IN AN IMAGE FORMATION DEVICE

(75) Inventor: Tsuyoshi Kushida, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 379 days.

(21) Appl. No.: 12/361,828

(22) Filed: Jan. 29, 2009

(65) Prior Publication Data

US 2009/0190947 A1 Jul. 30, 2009

(30) Foreign Application Priority Data

Jan. 30, 2008 (JP) ..... 2008-019571

(51) Int. Cl.
*G03G 15/00* (2006.01)
*G03G 15/043* (2006.01)

(52) U.S. Cl. ..... 399/72; 399/49; 399/51

(58) Field of Classification Search ..... 399/49, 399/51, 72

See application file for complete search history.

(56) References Cited

U.S. PATENT DOCUMENTS

| | | | |
|---|---|---|---|
| 6,563,524 | B1 | 5/2003 | Regimbal et al. |
| 6,626,101 | B2 | 9/2003 | Kajiwara et al. |
| 2001/0031148 | A1 | 10/2001 | Kajiwara et al. |
| 2002/0051048 | A1 | 5/2002 | Nishigaki et al. |
| 2003/0142988 | A1 | 7/2003 | Kimura |
| 2008/0019740 | A1 * | 1/2008 | Oouchi ..... 399/301 |

FOREIGN PATENT DOCUMENTS

| | | |
|---|---|---|
| EP | 1202125 A2 | 5/2002 |
| EP | 1202125 A3 | 1/2005 |
| JP | 2002-091115 | 3/2002 |
| JP | 2002-108042 | 4/2002 |
| JP | 2003-195605 | 7/2003 |
| JP | 2005-202284 | 7/2005 |

OTHER PUBLICATIONS

European Search Report for Application No. 09000235.3 dated Jul. 24, 2009.
Notification of Reasons of Rejection in connection with Japanese Application No. 2008-019571, mailed Apr. 15, 2010.
Notification of Reasons of Rejection for Japanese Application No. 2008-019571, mailed Dec. 8, 2009.
Office Action received for Chinese counterpart Application No. 200910002554.4, mailed Sep. 8, 2010.
Notification of the Second Office Action for Chinese patent application No. 200910002554.4 mailed Feb. 13, 2012.

* cited by examiner

*Primary Examiner* — Joseph S Wong
(74) *Attorney, Agent, or Firm* — Banner & Witcoff, Ltd.

(57) ABSTRACT

There is provided an image formation device, comprising: an image forming unit configured to execute image formation to form an image on a recording medium; a holding body configured to move relatively with respect to the image forming unit and to hold an image formed thereon by the image forming unit; a controller that controls the image forming unit to form a correction pattern in an area on the holding body, the area corresponding to an image formation area defined on the recording medium when the image formation is executed for the recording medium; a measurement unit configured to measure a position of the correction pattern formed on the holding body; and a correction unit configured to correct an image formation position of the image formation unit based on a measurement result of the measurement unit.

17 Claims, 12 Drawing Sheets

DISPLACEMENT DETECTION AND CORRECTION IN AN IMAGE FORMATION DEVICE

CROSS-REFERENCE TO RELATED APPLICATION

This application claims priority under 35 U.S.C. §119 from Japanese Patent Application No. 2008-019571, filed on Jan. 30, 2008. The entire subject matter of the application is incorporated herein by reference.

BACKGROUND

1. Technical Field

Aspects of the present invention relate to an image formation device.

2. Related Art

Image formation devices configured such that a plurality of image forming units of different colors are arranged along a lengthwise direction of a belt for conveying a sheet of paper and toner images respectively corresponding to the image forming units are formed on the sheet of paper being conveyed on the belt have been widely used. If displacement occurs between image formation positions of the image forming units, the image quality on the sheet of paper deteriorates.

Japanese Patent Provisional Publication No. 2002-91115 discloses an example of an image formation device which employs a technique (a so-called registration) for correcting displacement of image formation positions. One of factors causing such displacement of image formation positions is unevenness of the thickness of the belt. Since displacement due to unevenness of the thickness of the belt (i.e., variations in moving speed of the belt) occurs in a cycle period equal to the entire length of the belt.

Therefore, in a general registration scheme, a correction pattern formed of a plurality of marks having different colors is formed along the entire length of the belt, displacement between the marks of different colors is measured, and an average of the displacement is obtained for each color. By correcting the image formation position of each color based on results of the measurement, deterioration of the image quality can be prevented and thereby the print quality can be maintained.

SUMMARY

However, in general, the entire length of the belt is larger than the length of a sheet of paper. For example, the entire length of the belt is three times as large as the length of A4 size paper. Therefore, if the registration is executed immediately before a print operation, a waiting time for formation of a correction pattern along the entire length of the belt, measurement of the correction pattern and cleaning of the correction pattern is required.

Aspects of the present invention are advantageous in that an image formation device capable of decreasing a processing time including measurement of displacement of image formation positions is provided.

According to an aspect of the invention, there is provided an image formation device, comprising: an image forming unit configured to execute image formation to form an image on a recording medium; a holding body configured to move relatively with respect to the image forming unit and to hold an image formed thereon by the image forming unit; a controller that controls the image forming unit to form a correction pattern in an area on the holding body, the area corresponding to an image formation area defined on the recording medium when the image formation is executed for the recording medium; a measurement unit configured to measure a position of the correction pattern formed on the holding body; and a correction unit configured to correct an image formation position of the image formation unit based on a measurement result of the measurement unit.

According to the above described configuration, the correction pattern is formed only in the area corresponding to the image formation area of the recording medium, measurement is performed for the correction pattern, and the image formation position is corrected based on the measurement result. It is noted that if a correction pattern is formed over an area not used for image formation and then the correction pattern is measured, the time for formation of the correction pattern, measurement and cleaning increases accordingly, and thereby the start timing of the next image formation is delayed. By contrast, according to the above described configuration, since the correction pattern is formed only in an necessary area, the time for measurement of displacement of the image formation position can be decreased.

According to another aspect of the invention, there is provided a method to be implemented on an image formation device for executing image formation, comprising the steps of: forming a correction pattern in an area on a holding body of the image formation device such that the area corresponds to an image formation area defined on a recording medium when the image formation is executed for the recording medium; measuring a position of the correction pattern formed on the holding body; and correcting an image formation position of the image formation based on a measurement result of the measuring step.

According to the above described configuration, the correction pattern is formed only in the area corresponding to the image formation area of the recording medium, measurement is performed for the correction pattern, and the image formation position is corrected based on the measurement result. It is noted that if a correction pattern is formed over an area not used for image formation and then the correction pattern is measured, the time for formation of the correction pattern, measurement and cleaning increases accordingly, and thereby the start timing of the next image formation is delayed. By contrast, according to the above described configuration, since the correction pattern is formed only in an necessary area, the time for measurement of displacement of the image formation position can be decreased.

According to another aspect of the invention, there is provided a computer readable medium having computer readable instruction stored thereon, which, when executed by a processor of an image formation device, configures the processor to perform the steps of: forming a correction pattern in an area on a holding body of the image formation device such that the area corresponds to an image formation area defined on a recording medium when the image formation is executed for the recording medium; measuring a position of the correction pattern formed on the holding body; and correcting an image formation position of the image formation based on a measurement result of the measuring step.

According to the above described configuration, the correction pattern is formed only in the area corresponding to the image formation area of the recording medium, measurement is performed for the correction pattern, and the image formation position is corrected based on the measurement result. It is noted that if a correction pattern is formed over an area not used for image formation and then the correction pattern is measured, the time for formation of the correction pattern, measurement and cleaning increases accordingly, and thereby the start timing of the next image formation is delayed. By contrast, according to the above described configuration, since the correction pattern is formed only in an necessary area, the time for measurement of displacement of the image formation position can be decreased.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
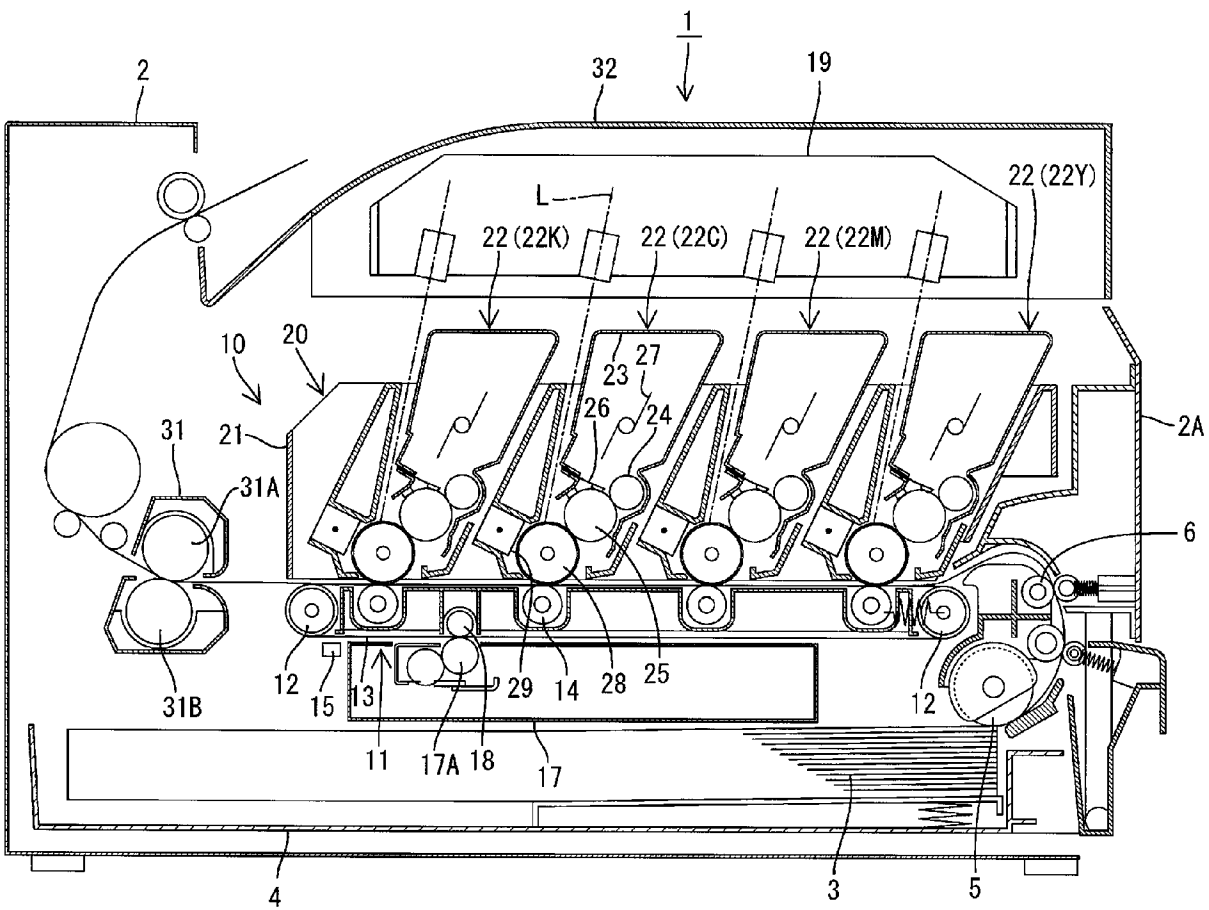
FIG. 1 is a side cross section illustrating a general configuration of a printer according to an embodiment.

FIG. 1 is a side cross section illustrating a general configuration of a printer 1 (an image formation device) according to an embodiment. The right side on FIG. 1 corresponds to the front side of the printer 1.

The printer 1 has a body casing 2. A paper supply tray 4 on which sheets of paper 3 is placed is located at the bottom of the casing 2. On the paper supply tray 3, various types of sheets of paper can be placed in portrait or landscape orientation. For example, portrait-oriented A3 paper, portrait-oriented B4 paper, portrait or landscape oriented A4 paper, or portrait or landscape oriented B5 paper can be placed on the paper supply tray 4. On the upper side of the paper supply tray 4, a paper feed roller 5 is provided. With rotations of the paper feed roller 5, a sheet of paper 3 on the top of the stack of paper is carried toward a registration roller 6. After correcting skew of the sheet of paper 3, the registration roller 6 carries the sheet of paper 3 toward a belt unit 11 in an image forming unit 10.

The image forming unit 10 includes the belt unit 11, a scanner unit 19, a process unit 20 and a fixing unit 31.

The belt unit 11 is provided such that a ring-shaped belt 13 is hooked on a pair of belt support rollers 12. The belt 13 has the width larger than the width of the maximum size of the sheet of paper 3 (e.g., the width of A3 size paper) and the length larger than the length of the maximum size of the sheet of paper 3 (e.g., the length of A3 size paper). By rotating the belt support roller 12 positioned at the rear side, the belt 13 circulates in a counterclockwise direction and thereby the sheet of paper 3 is carried toward the rear side on an upper surface of the belt 13. Inside the belt 13, transfer rollers 14 are provided at respective positions of photosensitive drums 28 of the process unit 20 to sandwich the belt 13 between each transfer roller 14 and each photosensitive drum 28.

To face the bottom surface of the belt 13, a pair of pattern sensors 15 which detects a pattern formed on the belt 13 is provided. The pattern sensor 15 illuminates the surface of the belt 13, receives light reflected from the surface of the belt 13 through a light receiving unit (e.g., a photo transistor) (not shown), and outputs a signal having a voltage level corresponding to the amount of received light. Under the belt unit 11, a cleaning unit 17 which collects extraneous materials, such as toner or paper dust, adhered to the surface of the belt 13 is provided. The cleaning unit 17 is provided with a cleaning roller 17A located to constantly contact the bottom surface of the belt 13. The cleaning roller 17A is positioned to face a backup roller 18 provided in the belt unit 11. That is, the belt 13 is sandwiched between the cleaning roller 17A and the backup roller 18.

By applying a predetermined bias to the space between the cleaning roller 17A and the backup roller 18 when the cleaning roller 17A is rotated in a reverse rotational direction with respect to the rotational direction of the belt 13, toner on the belt 13 is electrically attracted to the side of the cleaning roller 17A.

The scanner unit 19 has laser emission units (not shown) respectively emitting a plurality of colors of laser beams. The scanner unit 19 illuminates outer circumferential surfaces of the photosensitive drums 28 with the plurality of colors of laser beams, respectively.

The process unit 20 includes a frame 21 and four development cartridges 22 (22Y, 22M, 22C and 22K) attached to respective cartridge mounts. The four development cartridges 22Y, 22M, 22C and 22K respectively correspond to four colors of yellow, magenta, cyan and black. In the lower part of the frame 21, each development cartridge 22 is provided with the photo-sensitive drum 28 having an outer circumferential surface covered with a photosensitive layer having a positive electrostatic property and a charger 29 of a scorotron type. Because all of the development cartridges 22Y, 22M, 22C and 22K have the same structure, in FIG. 1 reference numbers are assigned only for the development cartridge 22C and reference numbers for the other development cartridges are omitted for the sake of simplicity.

Each development cartridge 22 has a box-shaped casing. In the upper portion of the inside of the casing, a toner chamber 23 accommodating toner of a corresponding color is provided. Under the toner chamber 23, a supply roller 24, a development roller 25, a layer thickness restriction blade 26 and an agitator 27 are provided. The toner outputted from the toner chamber 23 is supplied to the development roller 25, and becomes positively charged between the supply roller 24 and the development roller 25. The toner supplied to the development roller 25 enters space between the layer thickness restriction blade 26 and the development roller 25 in accordance with rotations of the development roller 25. Then, the toner is adequately charged further by friction, and is held on the development roller 25 as a thin layer having a uniform thickness.

During an image formation process, the photosensitive drum 28 is rotated, and the outer circumferential surface of the photosensitive drum 28 is charged positively. Then, the positively charged part is scanned by the laser beam scanning at a high speed from the scanner unit 19, and thereby a latent image corresponding to an image to be formed on the sheet of paper 3 is formed on the outer circumferential surface of the photosensitive drum 28.

Next, when the toner positively charged on the development roller 25 contacts the photosensitive drum 28 with rotations of the development roller 25, the toner on the development roller 25 is supplied to the latent image formed on the outer circumferential surface of the photosensitive drum 28. Then, the latent image is visualized. That is, the toner image by the toner adhered to the exposed part of the outer circumferential surface of the photosensitive drum 28 is held on the outer circumferential surface of the photosensitive drum 28.

The toner image held on the outer circumferential surface of each photosensitive drum 28 is transferred to the sheet of paper 3 by a negative transfer voltage applied to the transfer roller 14 when the sheet of paper 3 carried by the belt 13 proceeds between the photosensitive drum 28 and the transfer roller 14.

The fixing unit 31 includes a heat roller 31A having a heat source and a pressure roller 31B pressing the sheet of paper 3 toward the heat roller 31A. The fixing unit 31 serves to fix the toner image transferred on the sheet of paper 3 by heat. The sheet of paper 3 on which the image is fixed by heat is carried to the upper side, and is ejected to an output tray 32 provided in the upper portion of the body casing 2.

Figure 2:
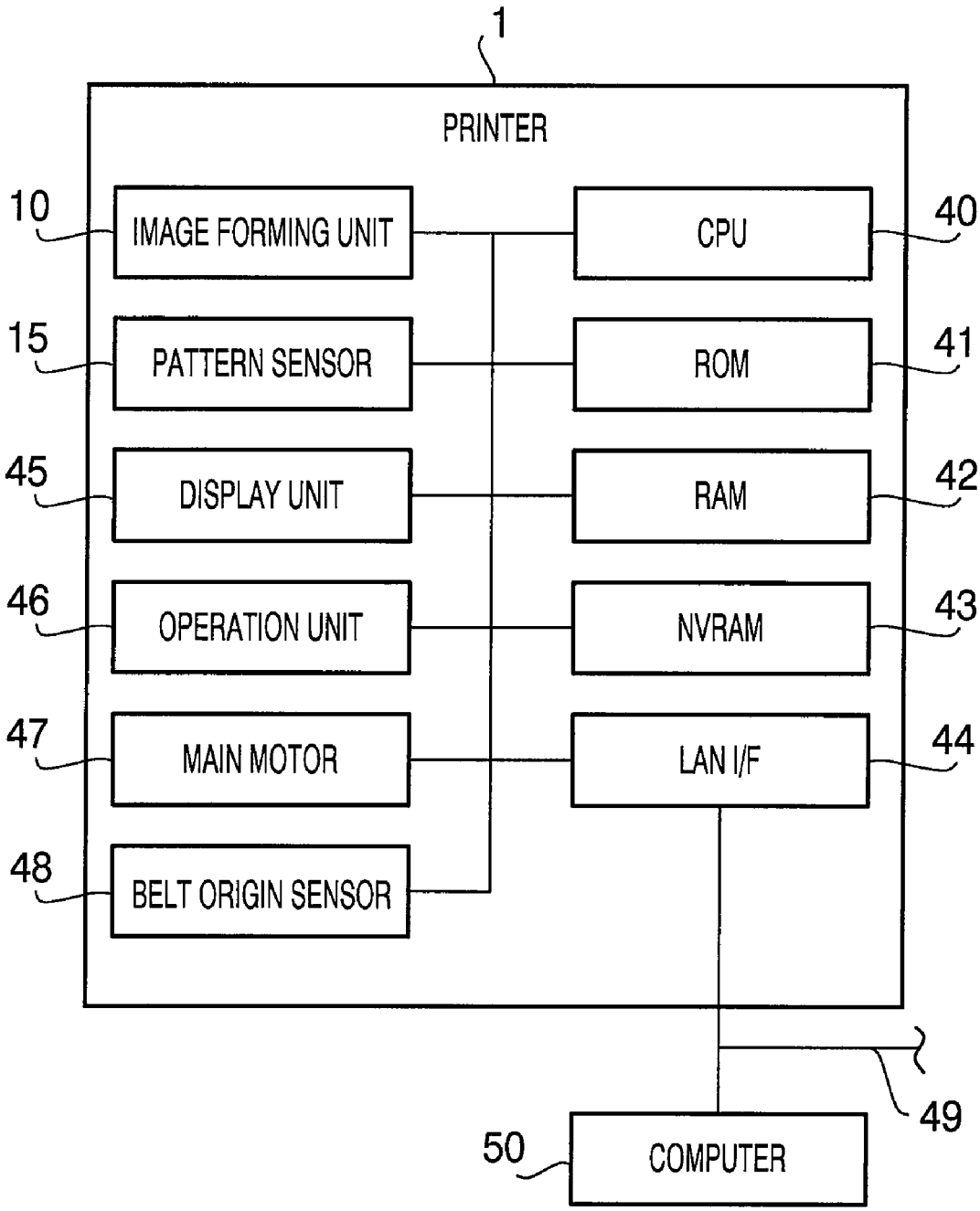
FIG. 2 is a block diagram illustrating a control system of the printer.

FIG. 2 is a block diagram illustrating a control system of the printer 1. As shown in FIG. 2, the printer 1 includes a CPU 40, a ROM 41, a RAM 42, an NVRAM (non-volatile memory) 43 and a network interface 44. Further, the printer 1 includes the above described image forming unit 10, the pattern sensor 15, a display unit 45, an operation unit 46, a main motor 47, and a belt origin sensor 48. These components are connected to each other.

The ROM 41 stores various programs (e.g., a correction and print control process) for executing various functions of the printer 1. The CPU 40 loads a program from the ROM 41 and controls the components in accordance with the program while storing processing results in the RAM 42 or the NV RAM 43. The network interface 44 interfaces the printer 1 with an external computer (e.g., a computer 50) through a communication network 49. With this configuration, the printer 1 is able to communicate with an external computer.

The display unit 45 includes a liquid crystal display and a lamp. On the display unit 45, various types of information, such as a setting screen or operational conditions of the printer 1, can be displayed. The operation unit 46 includes a plurality of buttons to be operated by a user. The main motor 47 serves to rotate the registration roller 6, the belt support roller 12, the transfer roller 14, the development roller 25, the photosensitive drum 28 and the heat roller 31A while synchronizing them with respect to each other. The belt origin sensor 48 detects an origin mark marked at an origin point on the surface of the belt 13.

Figure 3:
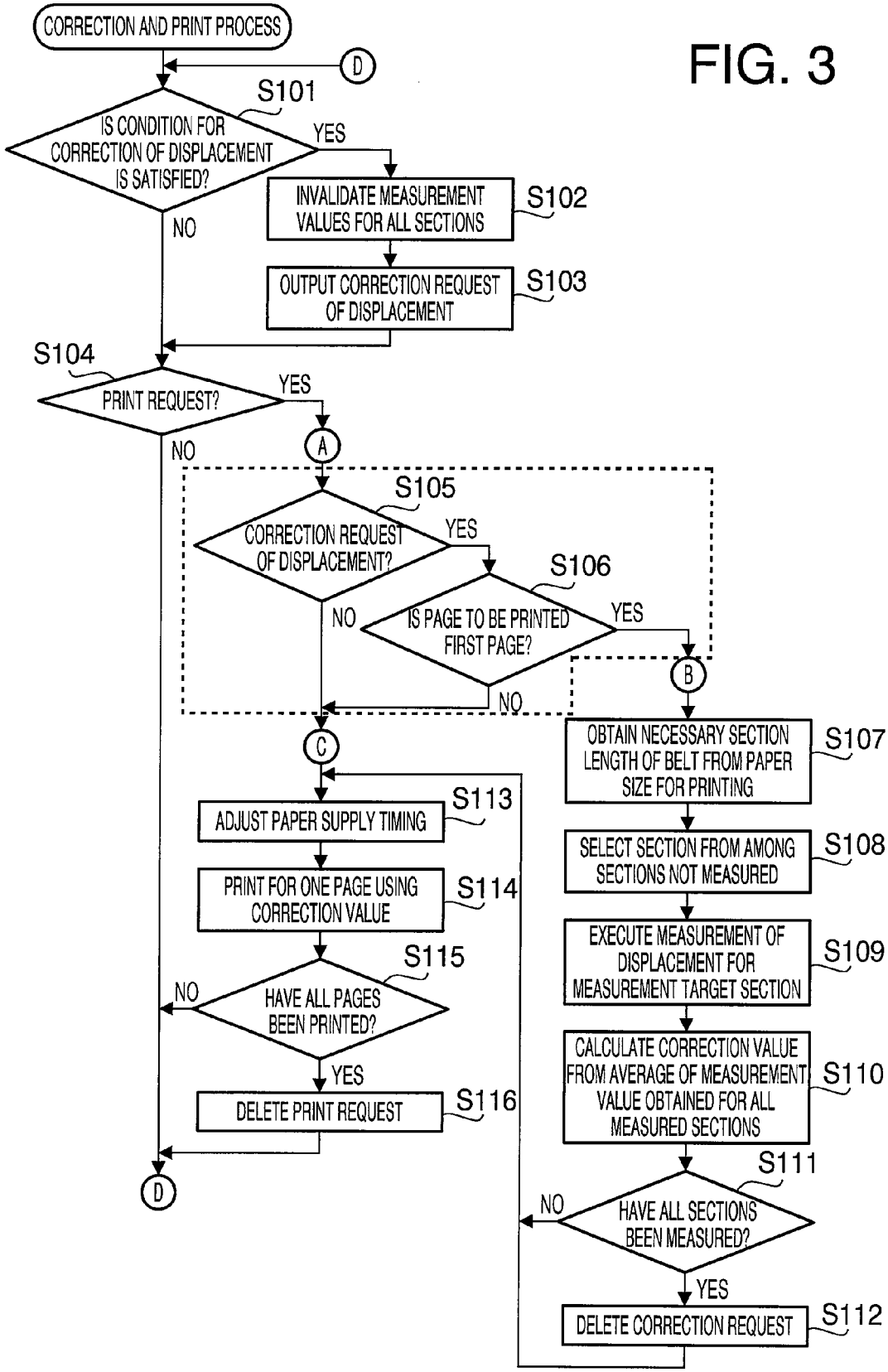
FIG. 3 is a flowchart illustrating a correction and print process executed by the printer.
Figure 4:
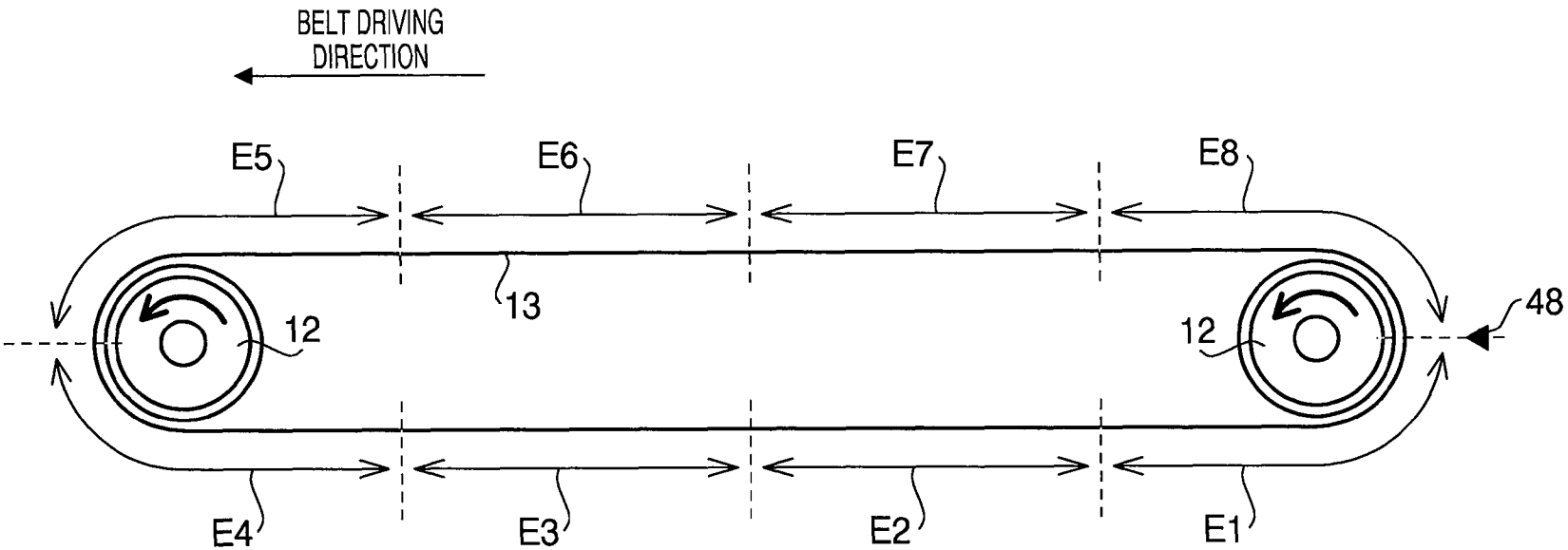
FIG. 4 is an explanatory illustration for explaining sections defined on a belt.
Figure 5:
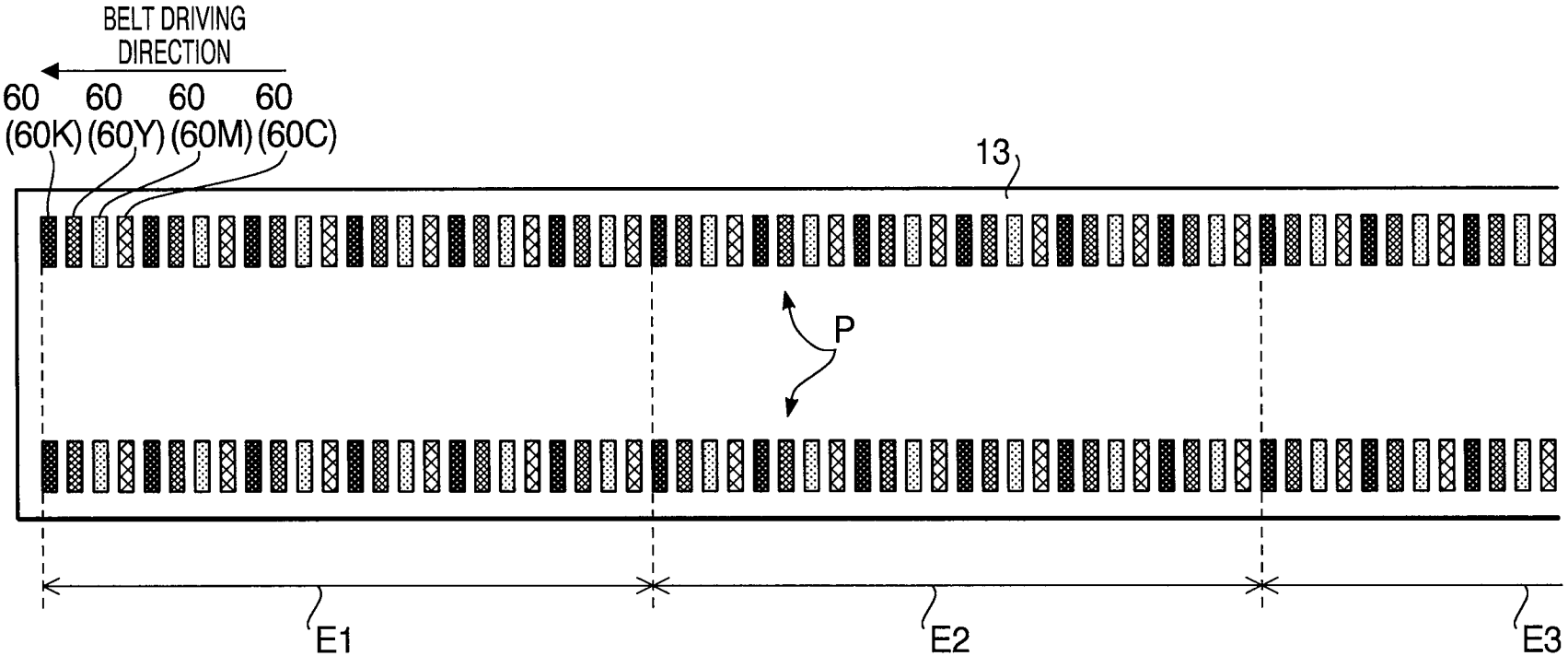
FIG. 5 illustrates a correction pattern used for correction of displacement of image formation positions.

Hereafter, the correction and print process executed under control of the CPU 40 of the printer 1 is explained with reference to FIG. 3. FIG. 3 is a flowchart illustrating the correction and print process. FIG. 4 is an explanatory illustration for explaining sections defined on the belt 13. FIG. 5 illustrates a correction pattern P used for correction of displacement of image formation positions.

First, the CPU 40 judges whether a condition for starting correction of displacement (a correction process) is satisfied (step S101). The CPU 40 judges that the condition for starting correction of displacement is satisfied, for example, if a sensor has detected opening and closing of the front cover 2A or if a predetermined time has elapsed from immediately preceding execution of the correction process.

As shown in FIG. 4, the outer circumferential surface of the belt 13 is divided uniformly into a plurality of sections along the rotational moving direction (i.e., the moving direction of the belt 13). As an example, the belt is divided into eight sections in FIG. 4. That is, the divided sections (E1-E8) have the same size. As described later, the correction process is executed such that the displacement is measured using each section E as a minimum unit for correction. The NVRAM 43 includes an area for storing information concerning the section E used for measurement and obtained measurement values.

If the condition for starting the correction process is satisfied, the CPU 40 invalidates measurement values in the NVRAM 43 obtained for all of sections E for which the measurement has been completed (step S102). Then, the CPU 40 outputs a request for correction of displacements (step S103). For example, in step S103, the CPU 40 sets a correction request flag in the NVRAM 43 to ON.

After the CPU 40 outputs the correction request in step S103 or the CPU 40 judges that the condition for starting the correction process is not satisfied (S101: NO), the CPU 40 judges whether a print request has been received (step S104). The print request is transmitted, for example, by the computer 50, through the network 40, and is received by the printer 1 via the network interface 44. The print request includes information, such as designation of the paper size and the number of copies. If no print request has been received (S104: NO), control returns to step S101 to wait until the print request is received.

If the print request has been received (S104: YES), the CPU 40 judges whether the print request includes the correction request (step S105). If the correction request is contained in the print request (S105: YES), the CPU 40 judges whether the page to be printed is the first page in the print request (step S106). If the first page is to be printed (S106: YES), the CPU 40 obtains the minimum section length of the belt 13 required for conveying the sheet of paper 3 during a print operation (step S107). For example, regarding the case where the designated paper size is A4 and the horizontally oriented A4 size paper is conveyed, if the shorter side of the sheet of paper 3 is larger than the length of two sections E and smaller than the length of three sections E, the minimum section length is determined as three sections.

Then, the CPU 40 refers to information stored in the NVRAM 43 to select a section E to be targeted for next measurement from among sections E for which the measurement of displacements has not bee executed (step S108). In this case, if non-measurement sections E (i.e., sections E for which measurement of displacements have not been executed) having the continuous length larger than or equal to the minimum section length of the belt 13 are found, the CPU 40 selects sections E continuously connected in the length corresponding to the minimum section length from among the non-measurement sections E, as targets for measurement. More specifically, if the non-measurement sections are sections E1-E5 and the minimum section length is three sections, the CPU 40 selects the sections E1-E3 as targets of the measurement.

The CPU 40 recognizes the position of the belt 13 based on detection timing of the origin point detected by the belt origin sensor 48. In step S108, if a plurality of groups of sections E can be selected as candidates for targets of the measurement, the section E which is on the upstream side with respect to the most upstream transfer position and is closest to the most upstream transfer position is selected. In other words, with respect to the present position of the belt 13, the section E for which formation of a correction pattern P can be started in a shortest time is selected. Consequently, the processing time required for the correction process can be decreased.

Next, the CPU 40 performs measurement of displacements of the sections E selected as measurement targets (step S109). First, the CPU 40 controls the image forming unit 10 to form the correction pattern P shown as an example in FIG. 5 in the measurement target sections E on the belt 13. As shown in FIG. 5, the correction pattern P is configured such that a plurality of units of marks, each of which has four marks 60 (60Y, 60M, 60C, 60K) respectively colored in yellow, magenta, cyan and black, are arranged, on the both sides of the belt 13, along the moving direction of the belt 13. The correction pattern P is used to measure displacement in an auxiliary scanning direction (i.e., in the moving direction of the belt 13). The marks 60 are arranged in the auxiliary scanning direction at certain intervals, and each mark 60 is formed to be elongated in the width direction of the belt 13.

The CPU 40 measures the position of each mark 60 by comparing an output level of the pattern sensor 15 with a predetermined threshold when the correction pattern P is situated to face the pattern sensor 15. For each of the plurality of units of marks, the CPU 60 obtains the displacement of each of three color marks (60Y, 60M, 60C) with respect to the black mark 60K. Then, the CPU 40 obtains, as a measurement value, an average of the measured displacement for each of the three color marks. In this case, if measurement values which have been obtained for another section E are stored in the NVRAM 43, the CPU 40 obtains an average of the measurement value stored in the NVRAM 43 and the current measurement value. Next, the CPU 40 stores a value for canceling the measurement value of the displacement of each color in the NVRAM 43 as a correction value. That is, the correction value for bringing the image formation position of an image of each color into line with the image formation position of a black color image is stored as a correction value (step S110).

Next, the CPU 40 judges whether the measurement has been finished for all of the sections E1-E8 on the belt 13 (step S111). If the measurement has been finished for all of the sections E1-E8 (S111: YES), the CPU 40 deletes the correction request (step S112). It should be noted that each mark 60 on the belt 13 is removed from the belt 13 when the mark 60 reaches the position facing the cleaning roller 17A after passing through the position of the pattern sensor 15.

If the CPU 40 has deleted the correction request in step S112, the CPU 40 judges that the measurement for all the sections E1-E8 has not been finished (S11: NO), the CPU 40 has not issued the correction request (S105: NO), or the CPU 40 judges that the page to be printed is not the first page (S106: NO), control proceeds to step S113 where the CPU 40 adjusts paper supply timing. In this case, the CPU 40 controls various rollers, such as the supply roller 5 and the registration roller 6, so that the sheet of paper 3 is carried by the section E for which the measurement has been finished.

Next, the CPU 40 corrects data to be provided for the scanner unit 19 based on the correction value obtained in step S110 so as to execute the print operation for one page through the above described image formation process while adjusting the image formation position of each color on the photo sensitive drum 28 (step S114). Then, the CPU 40 judges whether the print operation has been finished for all of the pages contained in the print request (step S115). If all of the pages have not been printed (S115: NO), control returns to step S101 to print the next page. If all of the pages have been printed (S115: YES), the CPU 40 deletes the print request in step S116, and thereafter control returns to step S101.

Figure 6:
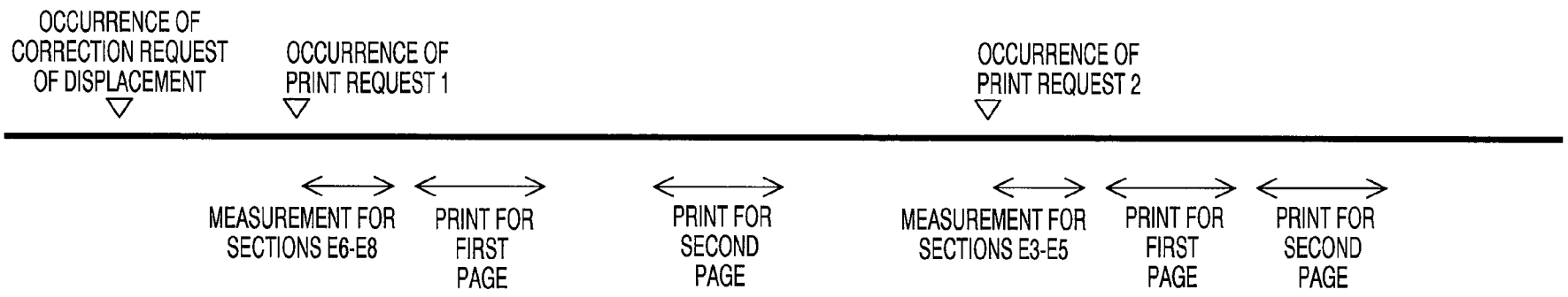
FIG. 6 illustrates timing of various processes in the correction and print process shown in FIG. 3.

FIG. 6 illustrates timing of various processes in the correction and print process shown in FIG. 3. As shown in FIG. 6, when the CPU 40 receives a print request 1 after outputting the correction request, the CPU 40 selects, for example, the sections E6-E8, as measurement targets, and obtains the correction value based on the measurement values. Then, the CPU 40 carries the sheet of paper 3 on the sections E6-E8 defined as the measurement targets, and then executes the print operation (e.g., the print operation for two pages) corresponding to the print request 1 based on the obtained correction value.

During the measurement for displacement, the driving of the belt and the image formation process for forming the correction pattern P is started from the state where the section E6 is situated at the position immediately before the first transfer position on the belt 13. After the correction pattern P is formed on the sections E6-E8, the measurement is performed by the pattern sensor 15, and the measurement is finished when the section E8 passes through the position of the pattern sensor 15. At this moment, the sections E6 to E8 are situated before the first transfer position. Subsequently, carrying of the sheet of paper 3 and the image formation process are started. That is, the sheet of paper is placed on the section E6, and an image is printed on the sheet of paper 3 when the section E6 reaches the first transfer position. In the above mentioned example, it is possible to complete the measurement approximately in a time in which the belt 13 rotates a turn and to start printing an image on the sheet of paper 3.

By contrast, if a correction pattern is formed on the entire circumferential surface of a belt and measurement is performed for the entire circumferential surface of the belt as in the case of a conventional technique, at least the time equal to the sum of the time in which the belt rotates a turn and the time for letting the belt move from the position of the first transfer position to the position of a pattern sensor is required for measurement.

Therefore, according to the embodiment, an area in which the correction pattern P is formed and the measurement is performed is limited to an area in which the sheet of paper is carried. Therefore, the time for measurement of displacement can be decreased.

In FIG. 6, after executing the print operation in accordance with the print request 1, the CPU 40 waits until a next print request 2 is received. When the print request 2 is received, the CPU 40 selects sections (e.g., sections E3-E5) different from those selected in the previous correction process, and performs the measurement for the newly selected sections. Then, the CPU 40 calculates the correction value in accordance with the preceding measurement results and the current measurement results, and executes the print operation corresponding to the print request 2 in accordance with the correction value. In the print operation, the sheet of paper 3 is carried with all the measured sections E3 to E8. Therefore, when the print operation is to be performed for a plurality of copies having the same paper size, it is possible to carry at least two sheets of paper during one turn of the belt 13. Therefore, it is possible to execute the print operation for a larger number of sheets in a shorter time than the process time of the preceding print process.

According to the embodiment, it is possible to form the correction pattern P only in the section E corresponding to the area to be used for image formation on the sheet of paper 3, and to correct the image formation position based on the measurement result of the correction pattern P. As described above, according to the conventional technique in which a correction pattern is formed in an area including a part not used for image formation, a relatively long time is required for the correction pattern formation, measurement and cleaning, and thereby start of the next image formation is delayed. By contrast, according to the embodiment, the correction pattern P is formed only in a necessary area, and therefore it is possible to decrease the time for measurement of displacement. It is also possible to secure an adequate degree of accuracy of correction by carrying the sheet of paper 3 on the measured section E, and to secure an adequate degree of image quality.

Further, based on the information, such as designation of paper size, contained in the obtained print request, the printer 1 defines the section E to be used for image formation. Therefore, the printer 1 is able to define the section E to be used for image formation in accordance with the data type of the image formation.

If an area for which the correction pattern P has not been measured is used during the image formation on a plurality of sheets of paper 3, the degree of accuracy for correction may decrease. By contrast, according to the embodiment, only the area for which the correction pattern P is measured is used for the image formation. Therefore, an adequate degree of image quality can be secured.

The printer 1 defines the section E in which the correction pattern P is formed next from among sections E for which the correction pattern P has not been formed. By thus repeating the measurement of displacement for each part on the belt 13, it is possible to decrease the time for each execution of measurement and to increase gradually the area for which the measurement has been finished. Therefore, if a plurality of sheets of paper 3 is to be carried during image formation only by an area for which the measurement has finished, it is possible to increase gradually the processing speed.

Second Embodiment

Hereafter, a correction and print process according to a second embodiment is described with reference to FIGS. 7 and 8. Since the configuration of the printer 1 according to the second embodiment is the same as that shown in FIGS. 1 and 2, reference numbers assigned to these drawings are also used for explanations of the second embodiment. In the following, explanations focus on the feature of the second embodiment. More specifically, the correction and print process according to the second embodiment is achieved by replacing steps surrounded by a box indicated by a dashed line in FIG. 3 with steps shown in FIG. 7.

Figure 7:
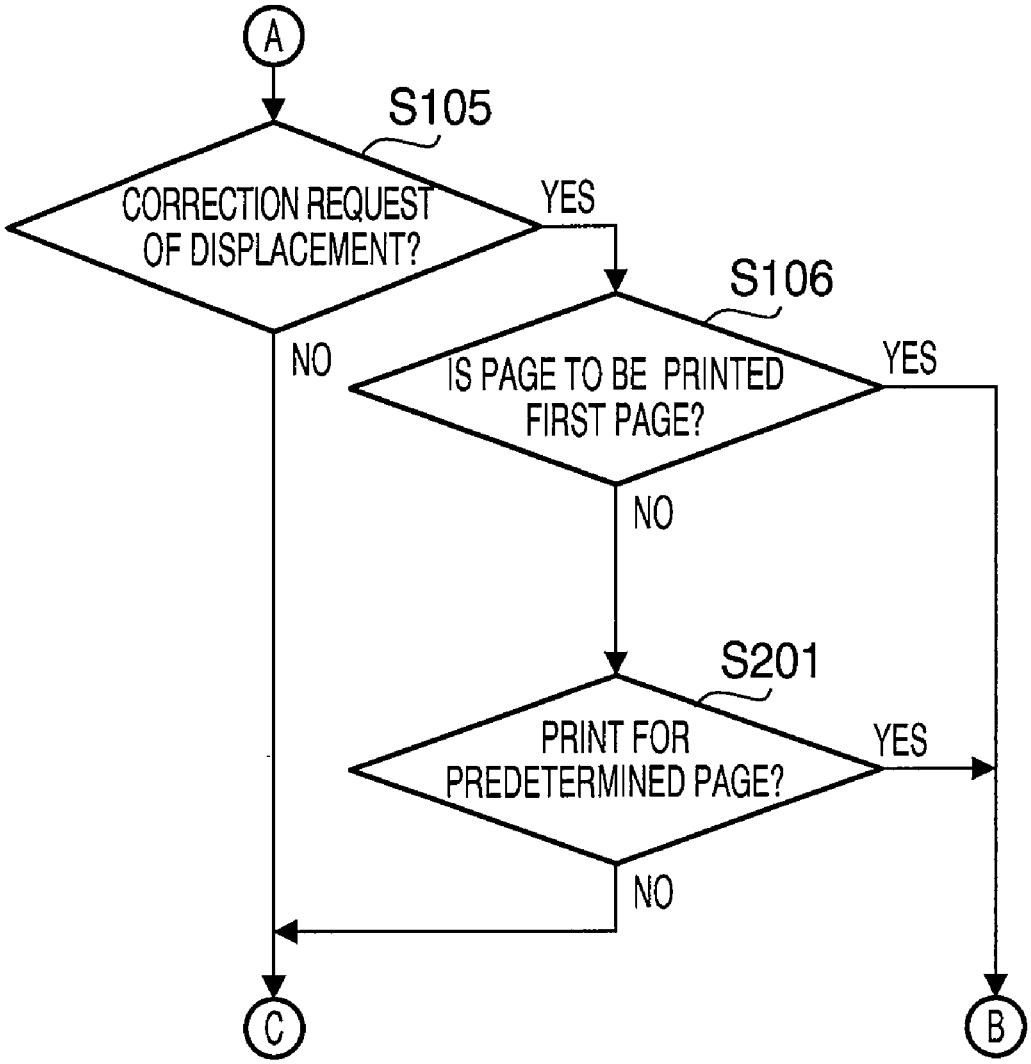
FIG. 7 shows feature of a correction and print process according to a second embodiment.

As shown in FIG. 7, if the CPU 40 judges that the page to be printed next is not the first page contained in the print request (S106: NO), the CPU 40 judges whether the page to be printed next is a predetermined page appearing on and after the page 2 (step S201). If the predetermined page is not reached (S201: NO), control proceeds to step S113 in FIG. 3 to print an image on the next page. If the predetermined page is reached (S201: YES), control proceeds to step S107 in FIG. 3, and then an image is formed on the next page after measuring displacement.

Figure 8:
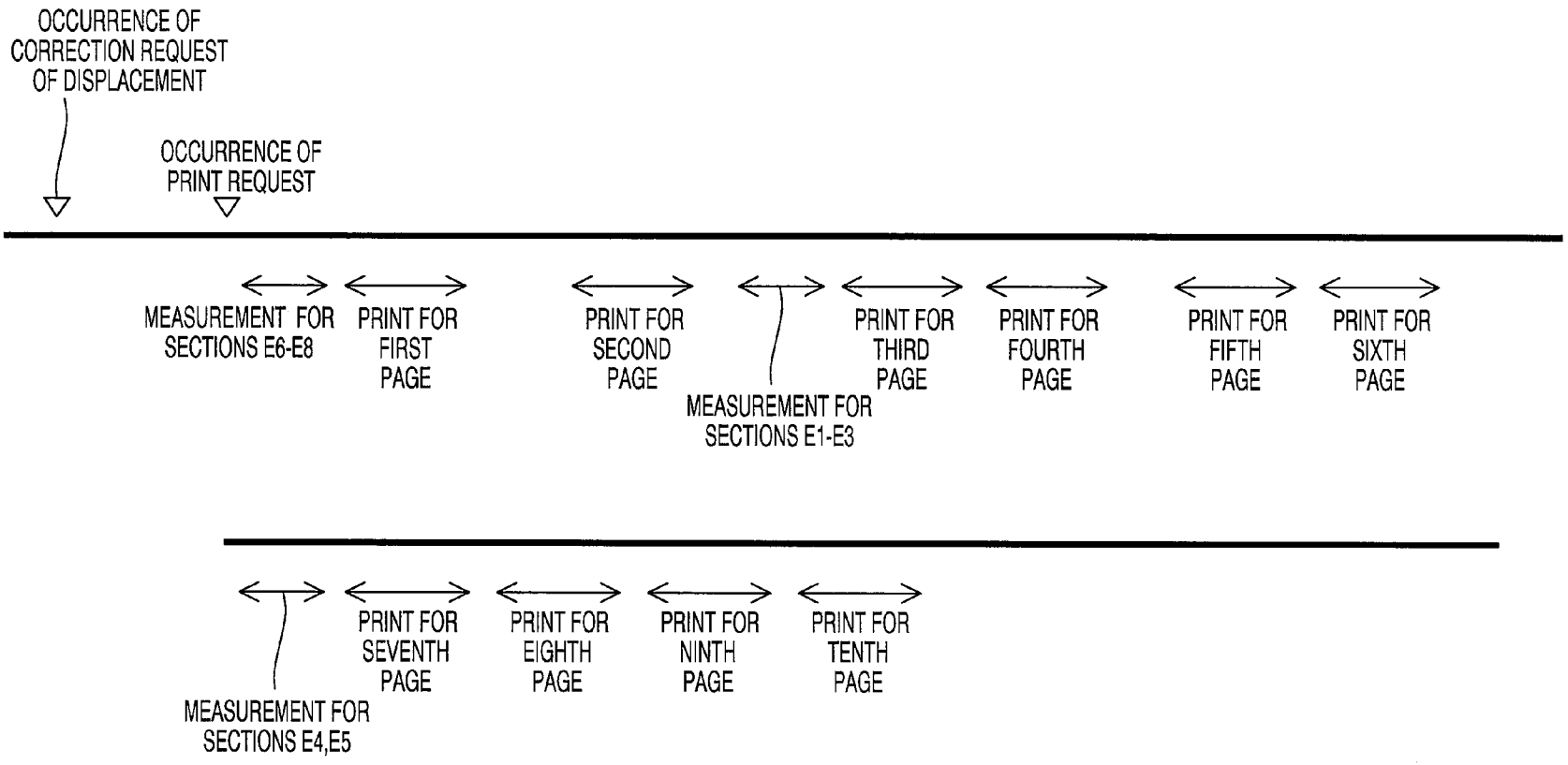
FIG. 8 is an explanatory illustration for explaining timing of various processes in the correction and print process according to the second embodiment.

FIG. 8 is an explanatory illustration for explaining timing of various processes in the correction and print process. In the example of FIG. 8, the third page and the seventh page is set as the predetermined page. The operation shown in FIG. 8 corresponds to the case where the CPU 40 receives the print request for 7 pages or more after outputting the correction request. When the CPU 40 receives the print request, the CPU 40 executes the first measurement of displacement for the sections E6-E8, and thereafter executes the print operation for the first and second pages while conveying the sheet of paper 3 on the sections E6-E8. Then, the CPU 40 executes the second measurement for other sections E1-E3, and thereafter executes the print operation for the second to sixth pages while carrying the sheet of paper 3 on the measured sections E1-E3 and E6-E8. After the third measurement is finished for the remaining sections E4 and E5, the CPU 40 executes the print operation for the page from the seventh page while conveying the sheet of paper 3 using all the sections E1-E8.

According to the second embodiment, if the number of pages to be printed is larger than a predetermined number of pages, the number of sections E for which formation of the correction pattern P and measurement are executed is increased. Therefore, the area which can be used for the image formation is increased, and therefore the image formation can be executed effectively in a relatively short time. Consequently, it is possible to decrease the total waiting time for measurement and the image formation process.

The above described correction and print process is useful particularly in the case where a print request does not have information concerning the total number of pages and the print operation is started before completion of receipt of the entire print data accompanying the print request (i.e., the case where the printer 1 is not able to recognize the total number of pages until the entire print data is received.).

Third Embodiment

Hereafter, a correction and print process according to a third embodiment is described with reference to FIG. 9. Since the configuration of the printer 1 according to the third embodiment is the same as that shown in FIGS. 1 and 2, reference numbers assigned to these drawings are also used for explanations of the third embodiment. In the following, explanations focus on the feature of the third embodiment. More specifically, the correction and print process according to the third embodiment is achieved by replacing steps surrounded by a box indicated by a dashed line in FIG. 3 with steps shown in FIG. 9.

The correction and print process according to the third embodiment is useful particularly in the case where the total number of pages is contained in the print request or the case where the print operation is started after all the print data is received (i.e., the case where the printer 1 is able to recognize the total number of pages before starting the print operation).

Figure 9:
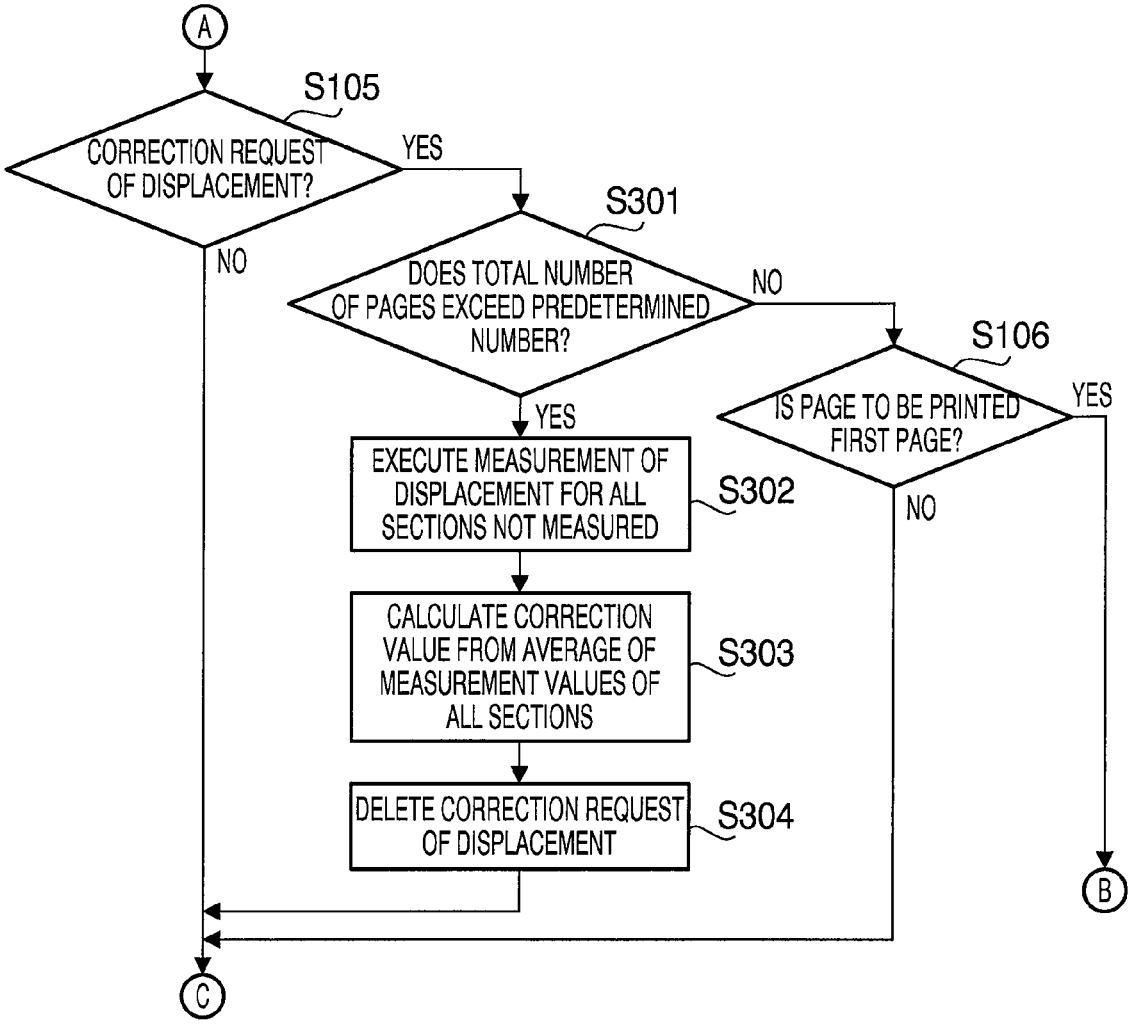
FIG. 9 shows feature of a correction and print process according to a third embodiment.

As shown in FIG. 9, when the correction request for correcting the displacement is found (S105: YES), the CPU 40 judges whether the total number of pages in the print request exceeds a predetermined number (e.g., the total number of pages≧2) (step S301). If the total number of pages does not exceed the predetermined number (S301: NO), control proceeds to step S106. Then, the measurement for displacement for the sections E selected as above is executed if the page to be printed is the first page. If the total number of pages exceeds the predetermined number (S301: YES), the measurement for displacement is performed for all the sections E for which the measurement is not performed.

Then, the correction value is calculated from an average of measurement values obtained for all the sections E1-E8 on the belt 13 (step S303). Then, the CPU 40 deletes the correction request for correcting displacement (step S304). Then, control proceeds to step S113 in FIG. 3. Subsequently, the CPU 40 prints for each page while adjusting the image formation position of each color on the photo sensitive drum 28 by correcting data to be supplied for the scanner unit 19 based on the correction value calculated as in the case of the first embodiment. Since the sheet of paper 3 is carried by all of the sections E1-E8, it is possible to reduce the time for printing for a large number of pages in comparison with the case where the sheet of paper is carried only by a part of the sections E.

According to the third embodiment, it is possible to execute the image formation effectively and in a relatively short time by increasing the number of sections E to be used for formation of the correction pattern P and the measurement in the case where the total number of pages to be printed is larger than a predetermined number of pages. Consequently, it is possible to reduce the total waiting time including the time for measurement and the image formation process.

Fourth Embodiment

Hereafter, a correction and print process according to a fourth embodiment is described with reference to FIG. 10. Since the configuration of the printer 1 according to the fourth embodiment is the same as that shown in FIGS. 1 and 2, reference numbers assigned to these drawings are also used for explanations of the fourth embodiment. In the following, explanations focus on the feature of the fourth embodiment. More specifically, the correction and print process according to the fourth embodiment is achieved by replacing steps surrounded by a box indicated by a dashed line in FIG. 3 with steps shown in FIG. 10.

Figure 10:
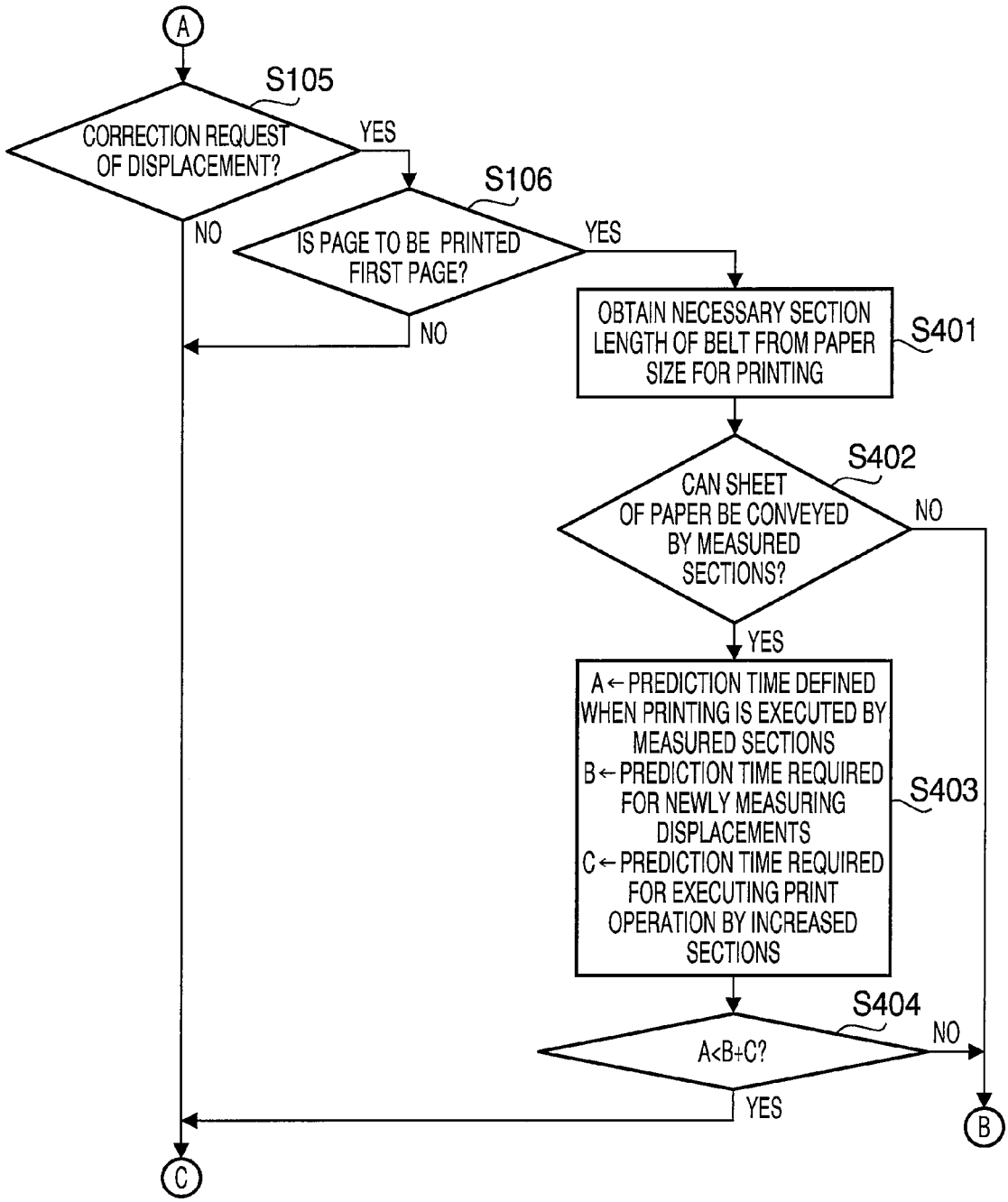
FIG. 10 shows feature of a correction and print process according to a fourth embodiment.

As shown in FIG. 10, if the page to be printed is the first page of the print request (S106: YES), the CPU 40 obtains the section length required for carrying the sheet of paper 3 based on the designation of the paper size contained in the print request (step S401). Then, the CPU 40 refers to the NVRAM 43 to judge whether the sheet of paper 3 to be printed next can be carried within the measured section (step S402). If the measured section E is not found or the sheet of paper 3 to be printed next can not be carried within the measured section (S402: NO), control proceeds to step S107 in FIG. 3. In this case, the CPU 40 measures displacement for the section E selected as the measurement targets, and executes the print operation.

In the above described correction and print process, the printer 1 may judge in step S402 that the sheet of paper 3 can not be carried in the measured section E if measurement of the required length of the section E and the print operation is performed for the B5 size paper, the sheet of paper 3 is changed from the B5 size paper to A4 size paper, and then the measurement of the required length of the section E and the print operation are performed for the A4 size paper.

If the sheet of paper 3 to be printed next can be carried within the measured section E (S402: YES), the CPU 40 calculates a prediction time required for executing the print operation for all of the pages using only the measure sections E (i.e., a time for carrying the sheets of paper only by the measured sections E), and assigns the calculated prediction time to a variation A. Then, the CPU 40 assigns a prediction time required for newly measuring displacement to a variation B (i.e., a time for executing steps from S107). Further, the CPU 40 assigns a prediction time required for executing the print operation for all of the pages using increased sections E including the already-measured sections E and the newly measured sections E, to a variation C (step S403).

Next, the CPU 40 compares the value of A with the value of (B+C). If (B+C) is larger than A (S404: YES), control proceeds to step S113 where the CPU 40 executes the print operation using only the already measured sections E. On the other hand, if (B+C) is not larger than A (S404: NO), control proceeds to step S107 where the CPU 40 newly measures displacement, and executes the print operation using the increased sections E (including the already-measured sections E and the newly measured sections E).

According to the second embodiment, if the image formation can be performed using only the already measured sections (S402: YES), the printer 1 performs the image formation without performing the formation of the correction pattern P and measurement. If the image formation can not be performed by only using the already measured sections E (S402: NO), the printer 1 newly forms the correction pattern P on the section E on which the correction pattern P has not been formed, and thereafter performs the image formation. With this configuration, it is possible to prevent unnecessary measurement of displacement from being executed on the printer 1. Consequently, waiting time for image formation can be decreased.

In this embodiment, if the number of pages to be printed is relatively low, the condition "A<B+C" is satisfied (S404: YES), and the image formation using only the already measured sections E without performing the formation of the correction pattern P and the measurement is executed. However, the correction and print process may be executed such that if it is judged that the image formation can be performed by only using the already measured sections E (S402: YES), control directly proceeds to step S113 to perform the image formation without processing steps S403 and S404.

It is understood that if the number of pages to be printed is relatively small, the processing time for performing image formation using only the already measured sections E tends to become shorter than the time for performing the image formation using the increased sections E. On the other hand, if the number of pages to be printed is relatively large, the processing time for performing image formation using the increased sections E tends to become shorter than the time for performing image formation using only the already measured sections E. According to the fourth embodiment, the image formation whose predicted processing time is a relatively short is selectively performed. Therefore, according to the fourth embodiment, it is possible to decrease the waiting time for performing image formation.

Fifth Embodiment

Hereafter, a correction and print process according to a fifth embodiment is described with reference to FIG. 11. Since the configuration of the printer 1 according to the fifth embodiment is the same as that shown in FIGS. 1 and 2, reference numbers assigned to these drawings are also used for explanations of the fifth embodiment. In the following, explanations focus on the feature of the fifth embodiment. The feature of the correction and print process shown in FIG. 11 is that a step S501 is added to the correction and print process shown in FIG. 3.

The correction and print process according to the fifth embodiment is useful particularly in the case where a single print request includes a monochrome page for which the print operation is performed with a single type of toner, and a multicolor page for which the print operation is performed with multiple types of toner.

Figure 11:
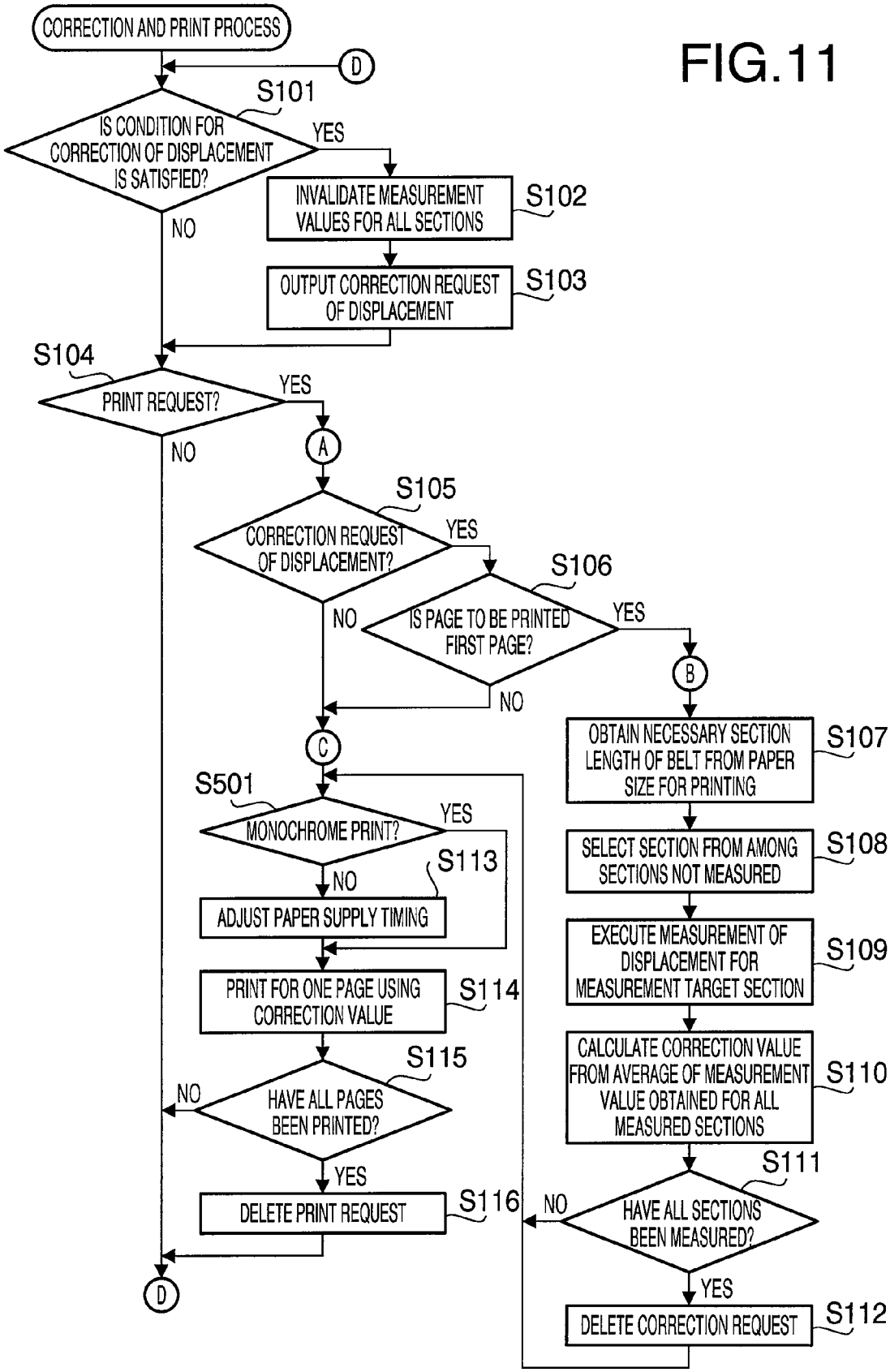
FIG. 11 shows feature of a correction and print process according to a fifth embodiment.

As shown in FIG. 11, if the CPU 40 deletes the correction request in step S112, if the CPU 40 judges that the measurement has not been finished for all the sections E1-E8 (S111: NO), if the correction request is not issued (S105: NO), or if the page to be printed is not the first page (S106: NO), control proceeds to step S501. In step S501, the CPU 40 judges whether the page to be printed next is a monochrome page for which the print operation is performed using a single type of tone. More specifically, the CPU 40 makes a judgment of S501 by referring to the designation of color (color/monochrome) in the print request or refers to body data of the print data to judge whether the page is a monochrome page.

If the page to be printed is not a monochrome page (S501: NO), control proceeds to step S113 where the CPU 40 adjusts supply timing of carrying the sheet of paper 3 on the already measured sections E. Then, the print operation is performed in step S114. On the other hand, if the page to be printed is a monochrome page (S501: YES), control proceeds to step S114 to execute the print operation without executing adjustment of the supply timing. That is, in this case, the CPU 40 does not judge whether the area on which the sheet of paper 3 is carried is already measured. Therefore, it is possible to start the carrying of the sheet of paper 3 in a short time. Consequently, it is possible to decrease the entire processing time.

As described above, according to the fifth embodiment, if color printing having a high possibility of requiring the correction of displacement is to be performed, the image quality is secured by performing the image formation only using the already measured sections E on the belt 13. If monochrome printing having a low degree of necessity for correction of displacement is to be performed, the image formation is performed additionally using an area other than the already measured area. Therefore, the processing time for image formation can be decreased.

Sixth Embodiment

Hereafter, a correction and print process according to a sixth embodiment is described with reference to FIG. 12. Since the configuration of the printer 1 according to the sixth embodiment is the same as that shown in FIGS. 1 and 2, reference numbers assigned to these drawings are also used for explanations of the sixth embodiment. In the following, explanations focus on the feature of the sixth embodiment. More specifically, the correction and print process according to the sixth embodiment is achieved by replacing steps surrounded by a box indicated by a dashed line in FIG. 3 with steps shown in FIG. 12.

Figure 12:
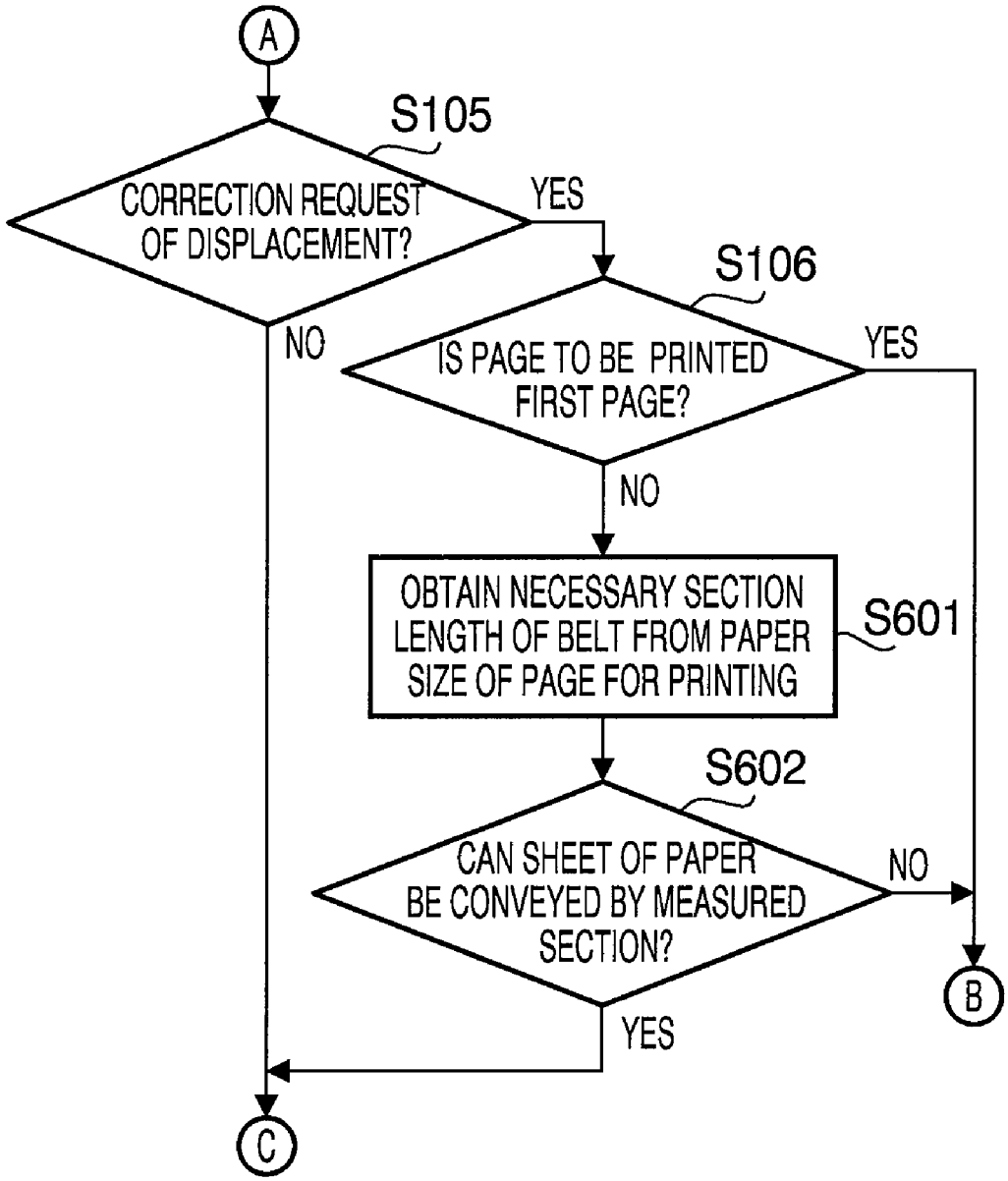
FIG. 12 shows feature of a correction and print process according to a sixth embodiment.

As shown in FIG. 12, if the CPU 40 judges that the page to be printed next is not the first page (S106: NO), the CPU 40 obtains the section length required for carrying the sheet of the page during the print operation based on the paper size of the page (step S601). Then, the CPU 40 judges whether the sheet of the page can be carried within the already measured section E (step S602). If the sheet of the page can not be carried within the already measured section E (S602: NO), control proceed to step S107 to perform the print operation after the measurement of displacement for new sections E. If the sheet of the page can be carried within the already measured section E (S602: YES), control proceeds to step S113 where the page is subjected to the print operation using the already measured section E.

According to the sixth embodiment, it is possible to carry the sheets of paper using the already measured sections even if a single print request contains a plurality of types of paper sizes. Therefore, it is possible to secure a high degree of accuracy of correction.

Although the present invention has been described in considerable detail with reference to certain preferred embodiments thereof, other embodiments are possible.

In the above described embodiment, the printer 1 formed as an image formation device based on a direct transfer scheme carrying a sheet of paper with a belt. However, the above described embodiments can also be achieved on an image formation device based on an intermediate transfer scheme in which image formation is performed with an intermediate transfer body (e.g., an intermediate transfer belt or an intermediate transfer drum). If measurement of displacement is performed on such an intermediate transfer type printer, it is possible to decrease the processing time for measurement by forming a correction pattern only on an area which is defined as a part of a surface of the intermediate transfer body and in which an image to be transferred to a recording medium is formed.

In the above described embodiment, the printer 1 defines the correction value based on an average of the measurement value of the already measured section and the measurement value of the newly measured section, and performs the image formation using the same correction value for all of the sheets of the pages to be carried on the already measured section. However, different correction values may be used depending on the position of the area used for the print operation.

For example, if a sheet of paper of the first page is carried on the sections E1-E3 and a sheet of paper of the second page is carried on the sections E4-E6, the first page may be subjected to the print operation by using the correction value obtained only from the measurement result of the sections E1-E3, and the second page may be subjected to the print operation by using the correction value obtained only from the measurement result of the sections E4-E6. By storing the measurement result for each of the sections, the printer 1 may execute the print operation for the same page such that a part on the page corresponding to the section E1 is corrected by using the correction value obtained from the measurement result for the section E1, and another part of the page corresponding to the section E2 is corrected by using the correction value obtained from the measurement result of the section E2. Consequently, the degree of accuracy of correction can be increased.

If the correction is performed based on the measurement result of the entire pattern when the pattern length is exceeds the distance between the position of the pattern sensor and the first transfer position, the leading edge of the pattern exceeds the first transfer position at the end of the measurement. Therefore, in such a case, it may become necessary to start the print operation after rotating the belt until the starting edge of the pattern reaches the first transfer position. By contrast, by performing the measurement for each of the divided sections and performing the print operation using different correction values obtained for respective divided sections, it becomes possible to start the print operation from the starting edge of the pattern before the measurement of the entire pattern is completed (i.e., before the trailing edge of the pattern passes the position of the pattern sensor).

In the above described embodiment, the area to be targeted for the measurement is defined to have the size corresponding to the paper size. However, the area to be targeted for the measurement may be defined by checking the size of an image to be printed in accordance with the print data. By this configuration, it becomes possible to decrease the measurement target in comparison with the case where the entire sheet of paper is defined as the measurement target.

In the above described embodiment, the measurement for all the sections of the belt 13 is achieved by executing measurement a plurality of times respectively for the divided sections on the belt. However, it is not necessary to execute the measurement for the entire image holding body (i.e., the belt) in response to one correction request. That is, the printer 1 may be configured such that in response to one correction request, the printer may perform the measurement only for a part of the belt until a new correction request is issued. In this case, it is possible to suppress consumption of toner or consumable parts in comparison with the case where the measurement is executed for the entire image holding body (i.e., the belt).

In the above described embodiment, the print operation is performed in accordance with a print request or print data transmitted from an external computer. However, the print operation may be executed for image data obtained by reading a document through a document reading unit (i.e., the scanner unit), or the print operation may be performed for image data stored in a storage medium (e.g., an USB memory).

The above described embodiment may be applied to an image formation device provided with a plurality of paper supply trays on which a plurality of types of recording medium having different paper sizes can be placed.

In the above described embodiment, the image formation device is configured such that a pattern for measuring displacement in the auxiliary direction is formed on the belt, and the correction for the auxiliary correction is executed. However, a pattern for correction of displacements and the correction of displacements are not limited to those shown in the above described embodiments. For example, a pattern for measuring displacement in a main scanning direction may be formed on the belt and the correction of the displacement in the main scanning direction may be executed. Alternatively, a pattern formed of a wedge symbol enabling the image formation device to measure displacements both in the main and auxiliary scanning directions may be formed on the belt, and the correction may be performed in regard to both in the main and auxiliary scanning directions.

In the above described embodiment, the cleaning roller of the cleaning unit constantly contacts the belt. However, the printer may be configured such that a cleaning member (i.e., the cleaning roller) moves away from the belt during the measurement of displacements and the image formation so that the degree of driving accuracy for the belt can be enhanced.

Assuming that an image formation device is configured to have an arrangement of a belt, a pattern sensor and a cleaning member (which can contact and moves away from the belt) shown in FIG. 1 and the measurement of displacement is executed for the entire belt, the measurement requires at least a time equal to the sum of the time in which the belt rotates a turn, the time in which the belt rotates from the first transfer position to the position of the pattern sensor, and the time in which the belt rotates a turn to clean the belt, amounting to the time equal to two and a half rotations of the belt.

By contrast, according to the embodiments, if the measurement is executed for a pattern formed on approximately three sections, the measurement requires at least a time equal to the sum of the time between the start of the pattern formation and the end of the measurement (i.e., a little less than a turn of the belt) and the time in which the belt is rotated over a turn and cleaning is performed, amounting to approximately two rotations of the belt. Accordingly, even if a cleaning member (which can contact and moves away from the belt) is used, it is possible to decrease the processing time for measurement of displacement.

What is claimed is:

1. An image formation device, comprising:

an image forming unit configured to execute image formation to form an image on a recording medium;

a holding body configured to move relative to the image forming unit and to hold an image formed thereon by the image forming unit, wherein a plurality of sections are defined on the holding body along a carrying direction of the recording medium; and a controller that controls the image forming unit to:

select a number of sections of the plurality of sections on the holding body in which to form a correction pattern based on a length of the recording medium, wherein the selected number of sections is less than a total number of sections defined on the holding body;

form a correction pattern in only an area of the holding body corresponding to the selected number of sections, wherein the selected number of sections corresponds to an image formation area configured to hold the recording medium when the image formation is executed for the recording medium;

measure a position of the correction pattern formed on the holding body; and correct an image formation position of the image formation unit based on the measured position of the correction pattern formed on the holding body.

2. The image formation device according to claim 1, wherein the holding body is configured to hold the recording medium on which an image is formed by the image forming unit.

3. The image formation device according to claim 2, wherein the controller is configured such that, in response to reception of an image formation command, the controller controls the image forming unit to execute the image formation and determines the image formation area based on data in the image formation command.

4. The image formation device according to claim 2, wherein the controller is configured such that, in order to execute the image formation for a plurality of recording media, the controller uses only the area for which the correction pattern has been measured.

5. The image formation device according to claim 2, wherein the controller is configured such that, in order to execute the image formation for a plurality of recording media, the controller compares a first prediction time required to execute the image formation for the plurality of recording media by only using the area for which the correction pattern has been measured with a second prediction time required to execute the image formation using both of the area for which the correction pattern has been measured and an additional area which is defined on the holding body to additionally form the correction pattern in the additional area and for which the correction pattern is to be measured, and executes the image formation in a manner corresponding to a shorter one of the first and second prediction times.

6. The image formation device according to claim 2, further comprising a storage unit configured to store information concerning the area in which the correction pattern is formed and the measured position, wherein the controller is configured such that in order to form the correction pattern on the holding body, the controller further consults the information in the storage unit to select the area to be used for formation of the correction pattern from among unused areas of the holding body.

7. The image formation device according to claim 2, further comprising a storage unit configured to store information concerning the area in which the correction pattern is formed and the measured position, wherein the controller is further configured to:

consult the information stored in the storage unit;

execute the image formation without newly executing formation of the correction pattern and measurement of the correction pattern if it is judged that the image formation can be executed by using only the area for which the correction pattern has already been measured; and execute the image formation after selecting the area on which the correction pattern is to be formed from among unused areas on the holding body, forming the correction pattern on the selected area and measuring the correction pattern if it is judged that that the image formation cannot be executed by using only the area for which the correction pattern has already been measured.

8. The image formation device according to claim 2, wherein the controller operates to increase a size of the area to be used for formation of the correction pattern if a number of recording media to be subjected to the image formation is larger than or equal to a predetermined number.

9. The image formation device according to claim 2, wherein:

the image forming unit is configured to form the image using a plurality of colors of coloring materials; and the controller executes the image formation by only using the area for which the correction pattern has already been measured if color image formation is to be executed, while the controller executes the image formation using the area for which the correction pattern has already been measured and another area on the holding body not used for formation of the correction pattern if monochrome image formation is to be executed.

10. The image formation device according to claim 2, wherein the controller is configured such that, if the image formation is performed for a plurality of recording media, the controller executes determining the area on which the correction pattern is formed and measuring the correction pattern when a page number of the recording medium to be subjected to the image formation reaches a predetermined number.

11. A method comprising the steps of:

defining, by an image formation device, a plurality of sections on a holding body along a carrying direction of a recording medium;

selecting, by the image formation device, a number of sections of the plurality of sections on the holding body in which to form a correction pattern based on a length of the recording medium, wherein the selected number of sections is less than a total number of sections defined on the holding body;

forming, by the image formation device, a correction pattern in only an area of the holding body of the image formation device corresponding to the selected number of sections, wherein the selected number of sections corresponds to an image formation area configured to hold the recording medium when image formation is executed for the recording medium;

measuring, by the image formation device, a position of the correction pattern formed on the holding body; and correcting, by the image formation device, an image formation position of the image formation based on a measurement result of the measuring step.

12. A non-transitory computer readable medium having computer readable instructions stored thereon, which, when executed by a processor of an image formation device, cause the image formation device to perform the steps of:

defining a plurality of sections on a holding body along a carrying direction of a recording medium;

selecting a number of sections of the plurality of sections on the holding body in which to form a correction pattern based on a length of the recording medium, wherein the selected number of sections is less than a total number of sections defined on the holding body;

forming a correction pattern in only an area of the holding body of the image formation device corresponding to the selected number of sections, wherein the selected number of sections corresponds to an image formation area configured to hold the recording medium when image formation is executed for the recording medium;

measuring a position of the correction pattern formed on the holding body; and correcting an image formation position of the image formation based on a measurement result of the measuring step.

13. The image formation device of claim 1, wherein the correction pattern includes at least three separately formed portions including a first portion, a second portion and a third portion, and wherein measuring the position of the correction pattern formed on the holding body includes measuring a first distance between the first portion and the second portion and a second distance between the first portion and the third portion.

14. The image formation device of claim 13, wherein measuring the position of the correction pattern further includes determining an average between the first distance and the second distance.

15. An image formation device, comprising:

an image forming unit configured to execute image formation to form an image on a recording medium;

a holding body configured to move relative to the image forming unit and to hold an image formed thereon by the image forming unit; and a controller that controls the image forming unit to:

form a correction pattern in an area of the holding body, the area corresponding to an image formation area configured to hold the recording medium when the image formation is executed for the recording medium;

measure a position of the correction pattern formed on the holding body; and correct an image formation position of the image formation unit based on the measured position of the correction pattern formed on the holding body, wherein an overall length of the holding body is divided into a plurality of equal, contiguous sections along a carrying direction of the recording medium, and wherein the area in which the correction pattern is formed is defined by a number of contiguous sections of the plurality of contiguous sections, wherein the number of contiguous sections is less than a total number of the plurality of contiguous sections such that the length of the area in which the correction pattern is formed is less than the overall length of the holding body.

16. A method comprising:

dividing, by an image formation device, an overall length of a holding body, configured to carry a recording medium, into a plurality of equal, contiguous sections along a carrying direction of the recording medium;

forming, by the image formation device, a correction pattern in an area on the holding body, wherein the area corresponds to an image formation area configured to hold the recording medium when image formation is executed for the recording medium, and wherein the area is defined by a number of contiguous sections of the plurality of contiguous sections, the number of contiguous sections being less than a total number of the plurality of contiguous sections such that the length of the area in which the correction pattern is formed is less than the overall length of the holding body;

measuring, by the image formation device, a position of the correction pattern formed on the holding body; and correcting, by the image formation device, an image formation position for the image formation based on the measured position of the correction pattern formed on the holding body.

17. A non-transitory computer readable medium storing computer readable instructions that, when executed, cause an image formation device to:

divide an overall length of a holding body, configured to carry a recording medium, into a plurality of equal, contiguous sections along a carrying direction of the recording medium;

form a correction pattern in an area on the holding body, wherein the area corresponds to an image formation area configured to hold the recording medium when image formation is executed for the recording medium, and wherein the area is defined by a number of contiguous sections of the plurality of contiguous sections, the number of contiguous sections being less than a total number of the plurality of contiguous sections such that the length of the area in which the correction pattern is formed is less than the overall length of the holding body;

measure a position of the correction pattern formed on the holding body; and correct an image formation position for the image formation based on the measured position of the correction pattern formed on the holding body.

* * * * *